United States Patent [19]

Larsen

[11] Patent Number: 4,629,518

[45] Date of Patent: Dec. 16, 1986

[54] CARBURIZATION AND HEAT TREATMENT PROCESS FOR A MACHINE PART

[75] Inventor: Dan B. Larsen, Jarfalla, Sweden

[73] Assignee: International Business Machines Corporation, Armonk, N.Y.

[21] Appl. No.: 678,867

[22] Filed: Dec. 6, 1984

[30] Foreign Application Priority Data

Feb. 14, 1984 [SE] Sweden ..... 84007814

[51] Int. Cl.[4] ..... C21D 1/74

[52] U.S. Cl. ..... 148/16.5; 148/20.3

[58] Field of Search ..... 29/DIG. 26, DIG. 21; 148/16.5, 39

[56] References Cited

PUBLICATIONS

Zaker W. L. "Selective Carburization Technique" IBM Technical Disclosure Bulletin, vol. 12, No. 4, Sep. 1969.

*Primary Examiner*—Christopher W. Brody

*Attorney, Agent, or Firm*—John S. Gasper

[57] ABSTRACT

A carburization and heat treatment process of a machine part for obtaining different depths of carburizations in different surfaces of the machine part. The process consists of the steps of; deep carburization of a partly preformed blank of the machine part (FIG. 2A and 2B) to a suitable depth of carbon penetration, machining the partly preformed blank to desired sizes (FIG. 1A and 1B) thereby partly or completely removing the carburization in not preformed dimensions of the blank, shallow carburization of the machined machine part to a desired depth of carbon penetration, and finally heat treating of the machine part.

6 Claims, 7 Drawing Figures

CARBURIZATION AND HEAT TREATMENT PROCESS FOR A MACHINE PART

The invention relates to a carburization and heat treatment process for a machine part, for example a print hammer.

Carburization and heat treatment processes are used to give machine parts desired tensile strength and wear properties. It may, for example, be desirable to have deep carburizations in some surfaces of the machine part and shallow carburizations in other surfaces, especially on machine parts having small cross sectional dimensions.

It is prior known to perform a carburization and heat treatment process by the following steps:

(a) the blank of the machine part is machined to drawing sizes, (b) all surface areas of the machine part except those which need deep carburization is covered with an electro deposited layer of copper, (c) a first deep carburization is performed, (d) the electro deposited copper layer is removed and (e) a final shallow carburization and heat treatment is performed.

This prior known carburization and heat treatment process requires a great number of process steps some of which being complicated to perform.

The invention as claimed is intended to remedy the above mentioned drawbacks. It solves the problem by means of a carburization and heat treatment process comprising the steps of:

(a) deep carburization of the partly preformed blank of the machine part, (b) machining the blank to drawing sizes and (c) performing shallow carburization and heat treatment of the ground machine part.

If more than two types of carburization are needed this can be accomplished by a suitable number of successive steps machining and carburization before the final heat treatment.

The advantages offered by the invention are mainly that the number of process steps is significantly reduced, the copper electroplating step and the step of removing the copper layer is eliminated. Further, the endurance limit is significantly increased and cheaper metal alloys may be used.

The invention, which is defined in the attached claim, is described in detail below with reference to the drawings which illustrate only one specific application, in which:

The invention is described in detail below with reference to the attached drawings which illustrate only one specific application of the invention, the carburization and heat treatment process for a print hammer. However, it is pointed out that the process is equally applicable in connection with the fabrication of other machine parts.

Figure 1A:
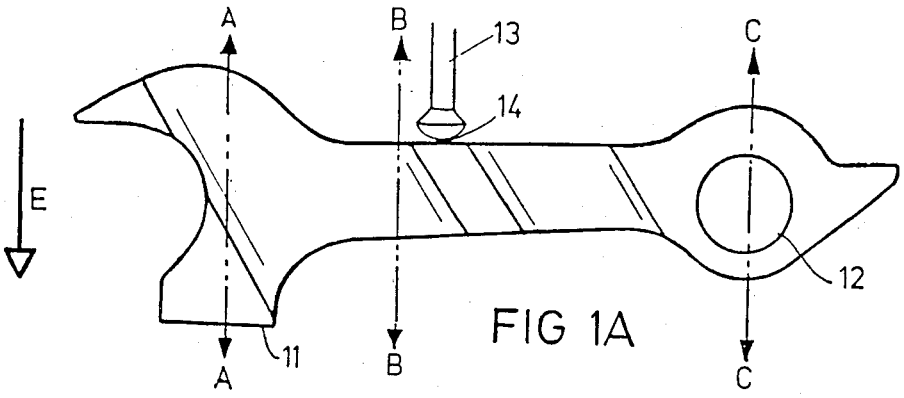
FIGS. 1A and 1B show a print hammer in side view and in front view.
Figure 1B:
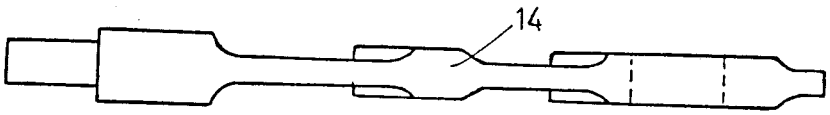

FIG. 1 shows a print hammer in side view, FIG. 1A, and in front view, FIG. 1B. The print hammer has a special design in order to meet the strength and endurance requirements in a high speed impact printer using a movable type-face-carrier, e.g., a rotatable printwheel or a chain printer.

In impact printers using movable type-face-carrier, printing is achieved by moving the type-face-carrier to present the character to be printed in front of a print position and then driving the print hammer from a rest position to an impact position wherein a character printing element borne by said type-face-carrier is struck by the hammer head, 11, onto a recording medium held by a platen cylinder.

The print hammer is pivotally supported on a pivot pin (not shown) in hole 12 and is held in its rest position by resilent means (not shown). The print hammer is actuated by a push rod, 13, which hits the print hammer in its actuating point, 14, for movement of the head, of the print hammer in the direction of arrow E.

Figure 3:
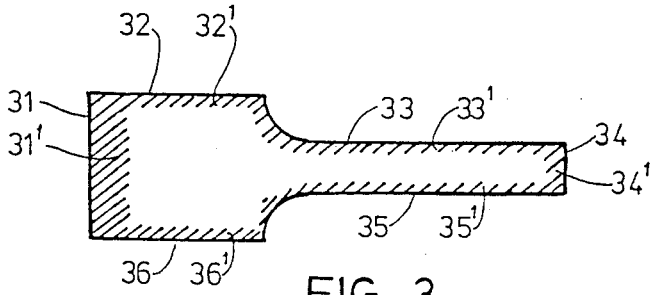
FIG. 3 is a cross sectional view along line A—A in FIG. 1.
Figure 4:
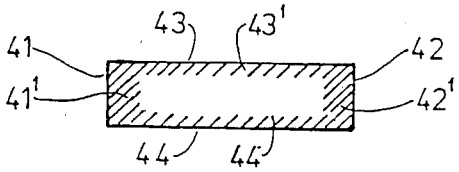
FIG. 4 is a cross sectional view along line B—B in FIG. 1.
Figure 5:
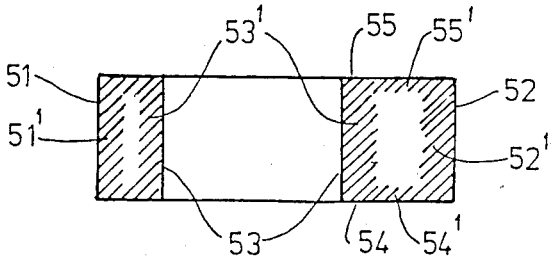
FIG. 5 is a cross sectional view along line C—C in FIG. 1.

In order to meet the strength, endurance and stability requirements and the requirement of being light-weight the print hammer has been given a special design as shown in FIGS. 1A and 1B. Besides, the print hammer must have a deep carburization of 0.25–0.35 mm in surface regions subjected to stress and/or wear, that means, all surface regions along the contour and round the hole 12 in FIG. 1A and a shallow carburization of 0.08–0.20 mm in all other surfaces. The distribution of the carburization for three cross sections of the print hammer is illustrated in FIGS. 3 to 5.

Figure 2A:
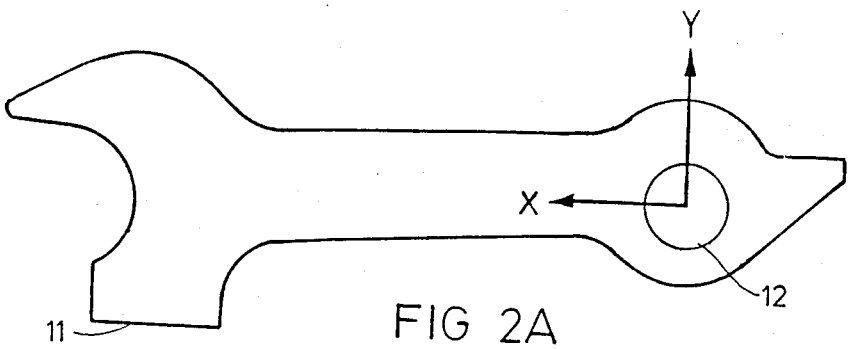
FIGS. 2A and 2B show a blank of a print hammer in side view and in front view with the contours of the print hammer in phantom.
Figure 2B:
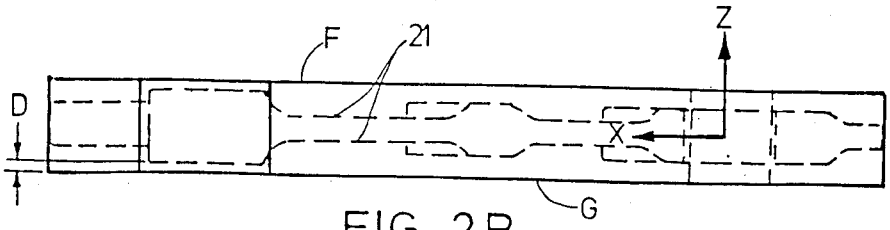

FIGS. 2A and 2B show a partly preformed blank of a print hammer in side view (A) and in front view (B). The blank has been machined or sintered to drawing sizes in the x and y dimensions are shown in FIG. 2A. FIG. 2B shows a front view of the blank with the contours, 21, of the print hammer in phantom. As shown in FIG. 2B there is a minimum distance D between the surfaces F and G of the blank and the contour, 21, of the print hammer. This minimum distance is about 0.35 mm.

The carburization and heat treatment process comprises the following steps:

(a) the partly preformed blank of the print hammer is carburized to a depth of 0.25–0.35 mm, (b) the blank is machined to drawing sizes in the Z dimension (the contour in FIG. 2B) whereby the carburized surface layers at the surfaces F and G are removed, (c) a final carburization to a depth of 0.08–0.20 mm together with a heat treatment is performed on the ground print hammer.

The resulting carburization is shown in FIGS. 3 to 5 for three cross sections of a finished print hammer.

FIG. 3 shows a cross section along line A—A in FIG. 1A. As seen in FIG. 3 there is a deep carburization layer 31' (0.25–0.35 mm deep) at the surface, 31, of the print hammer head, 11. Surface 31 of the print hammer head is during operation in a high speed printer subject to substantial wear. There is also a deep carburization layer 34' at the rear surface 34 of the print hammer, while at all other surfaces 32, 33, 35, 36 there are shallow carburization layers 32', 33', 35', 36' (0.08–0.20 mm deep).

FIG. 4 shows a cross section along line B—B in FIG. 1A. As seen in FIG. 4 there are deep carburization layers 41' and 42' (0.25–0.35) at the front surface 41 and the rear surface 42 of the print hammer and shallow carburization layers 43' and 44' (0.08–0.20 mm deep), at the side surface 43 and 44 of the print hammer.

FIG. 5 is a cross section along line C—C in FIG. 1A. As seen in FIG. 5 there are deep carburization layers 51' and 52' (0.25–0.35 mm deep) at the front surface 51 and the rear surface 52 of the print hammer and a deep carburization layer 53' at the surface 53 of the hole 12 of the print hammer which is subject to substantial wear during operation of the print hammer in a high speed printer and shallow carburization layers 54' and 55' at the surfaces 54 and 55.

Although the process has been described in connection with the fabrication of print hammers it is to be understood that the process can be varied in many ways without departing from the scope or the gist of the invention.

I claim:

1. A carburization and heat treatment process of a machine part for example a print hammer, characterized by the steps of;

a first carburization of the surface of a partly preformed blank of the machine part to a selected first depth of carbon penetration needed for one or more first surfaces of said machine part, at least a first machining after the first carburization step of the partly preformed blank to desired sizes required to form said machine part thereby substantially completely removing the carburization of selected portions of the carburized surface of said partly preformed blank to form second surfaces of said machine part, a second carburization after said at least first machining step of said machined part to a desired second depth of carbon penetration needed for said second surfaces of said machine part, said first depth of carbon penetration being greater than said second depth of carbon penetration, and a final heat treatment of said carburized and machined part.

2. A carburization and heat treatment process as claimed in claim 1, characterized by two or more successive machining and carburization steps before the final heat treatment.

3. A carburization and heat treatment process as claimed in claim 1, characterized in that the first carburization of the preformed blank is done to a first depth of 0.25–0.35 mm of carbon penetration, the machining to form said second surfaces is done to final sizes, and the second carburization is done to a second depth of 0.08–0.20 mm.

4. A carburization and heat treatment process as claimed in any of the claims 1, 2 or 3, characterized in that the machine part is a print hammer.

5. A carburization and heat treatment process as claimed in claim 1, characterized in that said partly preformed blank contains at least one surface which has been finally machined before said first carburization.

6. A carburization and heat treatment process as claimed in claim 5, characterized in that said one surface finally machined before said first carburization is a wear surface.

* * * * *